US009840073B2

(12) United States Patent
Ihme et al.

(10) Patent No.: US 9,840,073 B2
(45) Date of Patent: Dec. 12, 2017

(54) DRYING DEVICE, SYSTEM COMPRISING A DRYING DEVICE AND METHOD FOR OPERATING A DRYING DEVICE FOR DRYING BETWEEN INKING UNITS OF A PRINTING MACHINE

(71) Applicant: Windmöller & Hölscher KG, Lengerich (DE)

(72) Inventors: Andreas Ihme, Lengerich (CA); Frank Westhof, Recke (DE); Dietmar Pötter, Westerkappeln (DE); Markus Bauschulte, Ibbenbüren (DE); Martin Krümpelmann, Lengerich (DE); Moritz Koplin, Syke (DE); Frank Gunschera, Osnabrück (DE)

(73) Assignee: Windmöller & Hölscher KG, Lengerich (DE)

( * ) Notice: Subject to any disclaimer, the term of this patent is extended or adjusted under 35 U.S.C. 154(b) by 0 days.

(21) Appl. No.: 14/767,382

(22) PCT Filed: Oct. 29, 2013

(86) PCT No.: PCT/EP2013/072645
§ 371 (c)(1),
(2) Date: Aug. 12, 2015

(87) PCT Pub. No.: WO2014/124711
PCT Pub. Date: Aug. 21, 2014

(65) Prior Publication Data

US 2015/0367625 A1 Dec. 24, 2015

(30) Foreign Application Priority Data

Feb. 12, 2013 (DE) ..... 10 2013 101 350

(51) Int. Cl.
*B41F 35/00* (2006.01)
*B41F 3/52* (2006.01)
*B41F 23/04* (2006.01)

(52) U.S. Cl.
CPC ..... *B41F 3/52* (2013.01); *B41F 23/0426* (2013.01); *B41F 23/0463* (2013.01); *B41F 23/0466* (2013.01)

(58) Field of Classification Search
CPC ..... B41F 3/52
(Continued)

(56) References Cited

U.S. PATENT DOCUMENTS 2,268,987 A * 1/1942 Hess ..... B41F 23/0436 101/417
5,286,286 A * 2/1994 Winnik ..... C09D 11/30 106/31.15
(Continued)

FOREIGN PATENT DOCUMENTS

CH 151699 3/1932
DE 102010026604 1/2012
(Continued)

OTHER PUBLICATIONS

International Preliminary Report on Patentability dated May 28, 2015 From the International Preliminary Examining Authority Re. Application No. PCT/EP2013/072645.
(Continued)

*Primary Examiner* — Anthony Nguyen

(57) ABSTRACT

The invention relates to a drying device (10) for a drying between inking units of a printing machine (1), with which a substrate (2) can be transported via rotating cylinders (3.1, 3.2, 3.3) and is printable with a coloring agent (4), with an air supply unit (11) for supplying of air (5) in direction of the substrate (2) in order to effect a drying of the coloring agent (4), (Continued)

a suction unit (12) for discharging the air (5), a control unit (20), which controls and/or regulates the air supply unit (11) in dependence of the operating parameters (B) in a way that altering drying areas (13.1, 13.2, 13.3) are adjustable at the substrate (2).

20 Claims, 5 Drawing Sheets

(58) Field of Classification Search
USPC ..... 101/424.1
See application file for complete search history.

(56) References Cited

U.S. PATENT DOCUMENTS 5,724,437 A * 3/1998 Bucher ..... B41F 33/0036 101/183
5,832,833 A * 11/1998 Burgio ..... B41F 23/044 101/424.1
6,149,327 A * 11/2000 Ward ..... B41J 3/60 347/14
6,249,348 B1 * 6/2001 Jung ..... G01J 1/0411 250/226
6,401,608 B1 * 6/2002 Lyon ..... B41F 7/025 101/136
6,457,801 B1 * 10/2002 Fish ..... B41J 29/393 347/19
6,598,531 B2 * 7/2003 Nedblake, Jr. ..... B23K 26/0846 101/490
6,829,996 B2 * 12/2004 Jung ..... B41F 23/00 101/424.1
8,783,850 B2 * 7/2014 Stephens ..... B41J 3/543 101/424.1
2002/0144617 A1 * 10/2002 Compton ..... B41F 23/0403 101/424.1
2005/0141906 A1 * 6/2005 Murakami ..... G03G 21/00 399/45
2007/0079717 A1 * 4/2007 De Vries ..... B41F 33/0036 101/484
2007/0089623 A1 * 4/2007 Hamamoto ..... B41F 23/044 101/424.1
2008/0066638 A1 * 3/2008 Salgari ..... B41F 33/0036 101/484
2010/0192792 A1 8/2010 Hall et al.
2011/0205321 A1 * 8/2011 Kobayashi ..... B41J 2/155 347/102
2012/0092716 A1 * 4/2012 Ichimura ..... B41J 2/16505 358/1.15

FOREIGN PATENT DOCUMENTS

| | | |
|---|---|---|
| DE | 102010046756 | 3/2012 |
| DE | 102010062142 | 5/2012 |
| EP | 2135740 | 12/2009 |
| EP | 2404758 | 1/2012 |
| EP | 2578402 | 4/2013 |
| WO | WO 2010/026037 | 3/2010 |
| WO | WO 2010/071952 | 7/2010 |
| WO | WO 2014/124711 | 8/2014 |

OTHER PUBLICATIONS

International Search Report and the Written Opinion dated Apr. 8, 2014 From the European Patent Office Re. Application No. PCT/EP2013/072645 and Translation of Search Report in English.

Request for Examination [Pruefungsantrag] dated Jan. 7, 2014 From the German Patent and Trademark Office {Deutsches Patent—und Markenamt] Re. Application No. 102013101350.3.

Translation of Request for Examination [Pruefungsantrag] dated Jan. 7, 2014 From the German Patent and Trademark Office {Deutsches Patent—und Markenamt] Re. Application No. 102013101350.3.

* cited by examiner

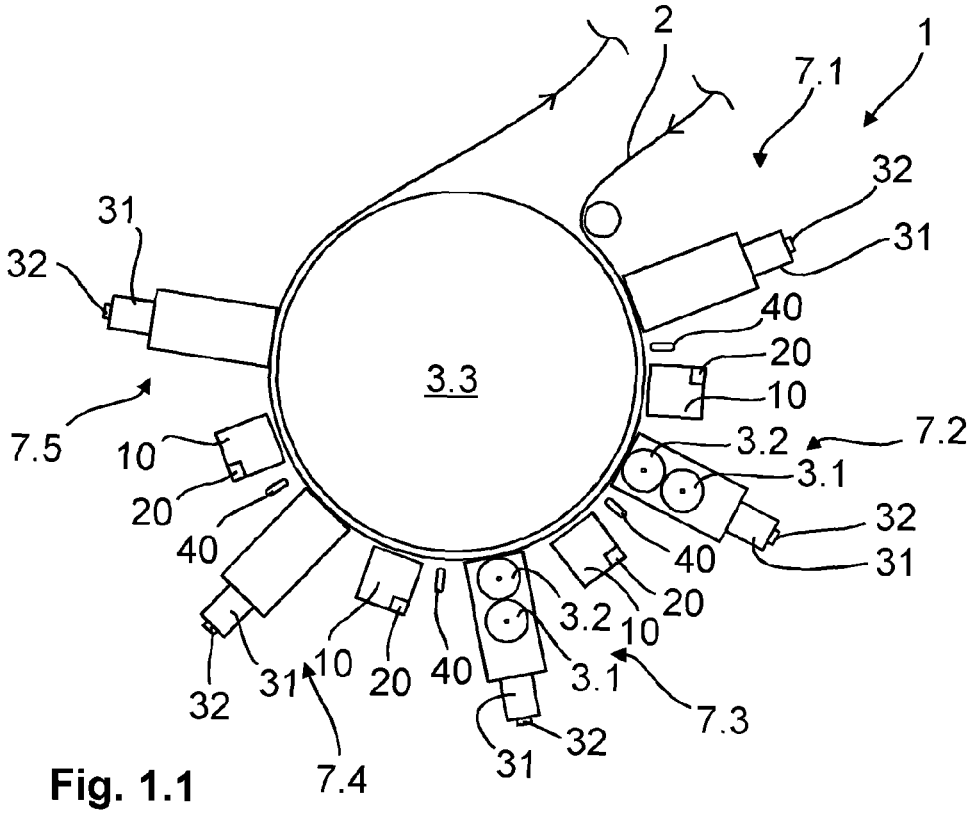
Fig. 1.1
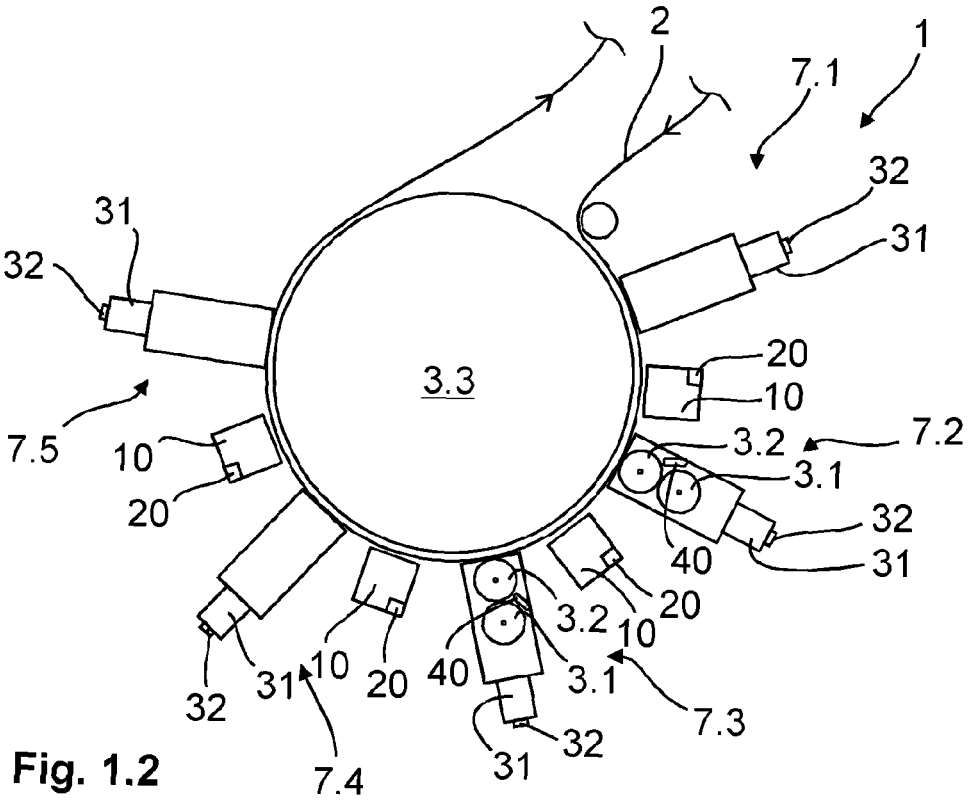
Fig. 1.2

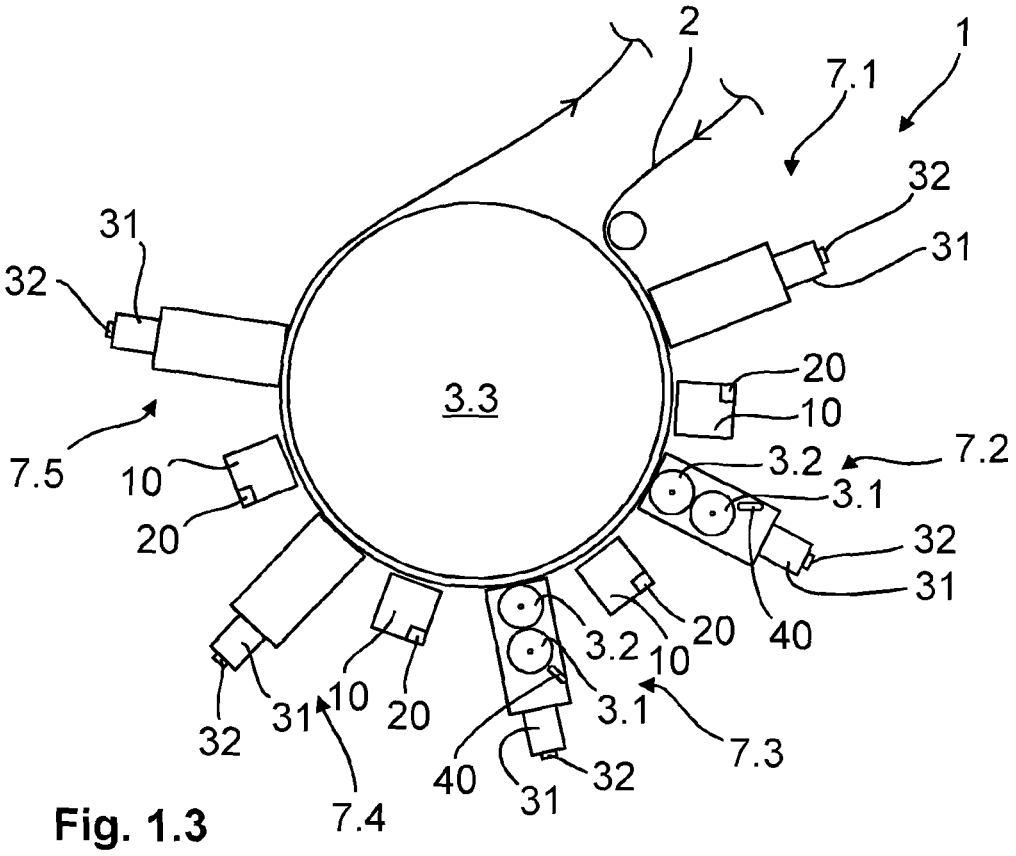
Fig. 1.3
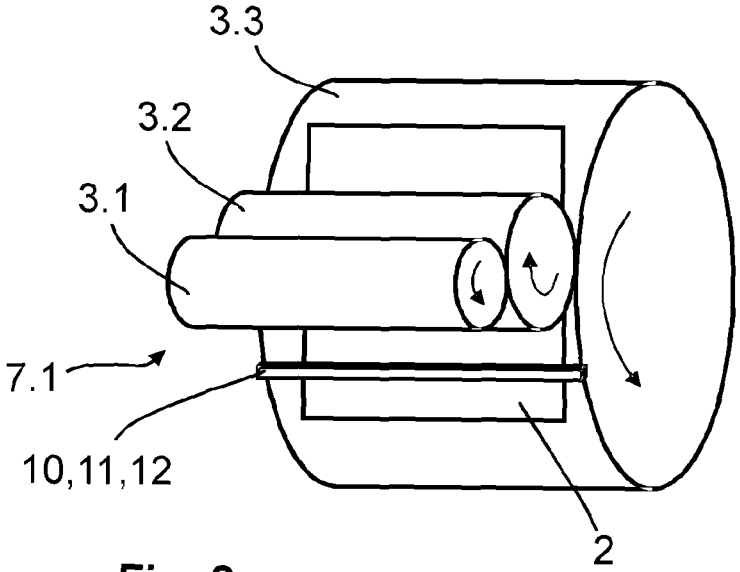
Fig. 2

DRYING DEVICE, SYSTEM COMPRISING A DRYING DEVICE AND METHOD FOR OPERATING A DRYING DEVICE FOR DRYING BETWEEN INKING UNITS OF A PRINTING MACHINE

RELATED APPLICATIONS

This application is a National Phase of PCT Patent Application No. PCT/EP2013/072645 having International filing date of Oct. 29, 2013, which claims the benefit of priority of German Patent Application No. 10 2013 101 350.3 filed on Feb. 12, 2013. The contents of the above applications are all incorporated by reference as if fully set forth herein in their entirety.

FIELD AND BACKGROUND OF THE INVENTION

The invention relates to a drying device for a drying between inking units of a printing machine and a system with said drying device. Further, the invention relates to a method for operating said drying devices.

It is known from the state of the art to intend drying devices between the inking units of a printing machine in order to dry the colouring agent applied to the substrate. Further, it is known that the drying capacity of the drying device is adjusted by an operator. In one possible embodiment the drying device can be equipped with a blower, which supplies air into the direction of the substrate during drying. From the state of the art it is known that the operator can adjust the blow air speed and/or blow air temperature individually. With solvent based colouring agents the air supply used for drying is also used for discharging/diluting of solvent vapours. High requirements are made during the printing process of the printing machine to the adjustment of differently constructed drying devices. Already during adjusting of the printing machine the operator has to carry out adjustments at the drying device in order to be able to produce the required quality at a particularly small amount of time and number of waste runs. An adjustment of the drying capacity chosen too high requires not only a high energy consumption but hereby, disadvantageously, also the printing process can be negatively influenced. An adjustment of the drying capacity chosen too low has to be avoided since otherwise the risk of spreading the recently printed substrate is created during the transport over the rotating cylinder.

SUMMARY OF THE INVENTION

The object of the present invention is to avoid the previously described disadvantages, particularly to establish a drying device, a system with a drying device and a method for operating a drying device so that significant energy savings are achievable during the operation of the drying process and at the same time a high printing quality is ensured.

Said object is solved by a drying device with all features of claim 1. Preferred embodiments of the invention are indicated in the dependent claims. Further, the invention is solved by a system with all features of claim 5. In the dependent claims 6 to 9, and 11 preferred embodiments of the system according to the invention are intended. Further, the object is solved by a method according to all features of claim 12. In the dependent claims possible embodiments are described.

According to the invention a drying device is intended for a drying between inking units of a printing machine, by which a substrate is transportable via rotating cylinders and printable with colouring agents, wherein the drying device comprises an air supply unit for supplying of air in the direction of a substrate in order to cause a drying of the colouring agent. Further, the drying device according to the invention comprises a suction unit for discharging of air, wherein according to the invention a control unit is intended, which controls and/or regulates the air supply unit in dependence of operating parameters in a way that alterable drying areas are adjustable at the substrate. It is particularly preferable that the control unit can adjust or alter the arising drying areas individually from the printing image at the substrate. Between each inking unit of the printing machine preferably a drying device is intended. It is possible that diverse alterable drying areas occur between the inking units since each inking unit individually applies its own printing images to the substrate, which differ from the printing images of the remaining inking units. The operating parameters can be quantities, which are already saved within the printing machine particularly the drying device. Likewise the invention comprises operating parameters, which are determined and/or measured and/or calculated during the operation of the printing machine particularly the drying device. Likewise a combination of said operating parameters is possible. The printing machine can also involve for example a flexographic printing machine, with which according of the invention the energy consumption can be significantly reduced via the automatic adjustment of the drying areas, wherein at the same time the solvents in the colouring agent, like for example ethanol, etc. can be effectively extracted from the substrate. The handle for the operator is further significantly facilitated since the drying device automatically adjusts the drying capacity in dependence from the printing image, which is defined by the colouring agent on the substrate. Therewith an intelligent drying control can be established, which automatically adjusts different drying areas between each inking unit of the printing machine. Via the operating parameters the air supply unit and/or the suction unit is controlled and/or regulated intelligently so that an adjustment of the drying capacity is almost excluded, which was chosen too high or too low, wherein the energy input of the drying device according to the invention can be optimized during the drying or during the operation of the printing machine.

Advantageously the air supply unit can comprise movably flaps, wherein an alterable flow direction is achievable for the discharge of air from the air supply unit. For example it is possible that the width of the air supply unit mainly corresponds to the width of the substrate.

Likewise it can be intended that the width of the air supply unit is individually adjustable corresponding to the width of the to be transported substrate. This applies for the suction unit accordingly, which can be assembled together with the air supply unit in a common component. The flaps can for example be regulated and/or controlled via the control unit, wherein one or multiple flaps can be completely closed so that at these positions no air can flow from the drying device in the direction of the substrate. According to the position of the flaps the flow direction of the air can be individually adjusted, wherein different drying areas adjust between the substrate and the drying device, particularly the air supply unit and/or the suction unit.

Advantageously multiple modules can be intended, which each comprise an air supply unit and a suction unit, wherein the modules are individually controllable by the control unit particularly that the volume flow and/or the temperature and/or the flow direction of the discharging air in the direction of the substrate of each module is individually adjustable. It is possible that in the centre an air supply unit is intended within the drying device, which serves for a sufficiently great volume flow of air in the direction of the substrate. The air supply unit can comprise a supply channel, through which the air flows in the direction of the substrate. This supply channel can be opened, closed and/or partly opened by one or multiple flaps. The suction unit can comprise one or multiple suction channels, through which the air can be sucked, which is enriched with solvent. For example it is possible that in the centre a supply channel is intended in the drying device, wherein two suction channels are intended in the drying device between which the supply channel proceeds.

Likewise the invention involves that the distance between the substrate and the drying device is adjustable, which can be determined via said operating parameters.

Said object is further solved by a system with all features of the independent claim 5. In the dependent system related claims possible embodiments are described.

According to the invention a system with a drying device is proposed for drying between inking units of a printing machine, by which a substrate is transportable via a rotating cylinder and is printable with colouring agents, wherein a printing image can be applied to the substrate by the colouring agents. The system comprises an air supply unit for supplying air in the direction of the substrate in order to effect a drying of the colouring agent. Further, the system comprises a suction unit for suctioning of air and a measuring unit, with which at least a part of operating parameters can be determined during the operation of the printing machine and/or the drying device. According to the invention a control unit is intended, which controls and/or regulates the air supply unit and/or the suction unit in dependence of the operation parameters in a way that the altering drying areas are adjustable at the substrate. It is particularly an advantage that an optimized drying of the colouring agent is achievable between the inking units, wherein at the same time the energy consumption of the system can be reduced since the drying device can be controlled and/or regulated individually for each inking unit, wherein the operating parameters determine the drying capacity according to each inking unit. The advantages of the previously described drying device are at this point likewise applicable within the scope of the system according to the invention.

Advantageously, the measuring unit can comprise an optical sensor, whose measuring range is directed to the substrate and/or at least a cylinder, wherein particularly the optical sensor is a camera unit and/or a sensor for the acquisition of the gloss level of the applied colouring agent. One or multiple operating parameters are measurable or can be determined by the optical sensor, wherein between the inking units the drying area and/or the drying areas are adjustable. The optical sensor can for example be a line scan camera. The optical sensor can using information about the printing image on the substrate, determine the size of the printed area of the substrate. Further, it is likewise possible that the printing degree of the printing image can be determined by the optical sensor, wherein the printing degree is determined over the density of the existing pattern points on the printing image. Hereby, it is possible that the printing image comprises a rough or a precise pattern, wherein the colour of the printing image is adjustable. The definition of the printing degree is for example comparable with the pixel resolution of a monitor. The optical sensor can be directed directly to the substrate in order to receive direct information according to the printing image wherein these information serves as an operating parameter for the adjustment of the drying area. Likewise it can be intended that the optical sensor is directed to one of the cylinders, for example a format cylinder and/or an anilox roller of the printing machine so that also with this embodiment information according to the printing image is deducible at the substrate, which in turn serves as operating parameters for the control unit in order to individually adjust drying zones at the substrate.

Likewise it is possible that at least one paint container is assigned to the printing machine in which the colouring agent can be inserted, wherein the paint container comprises an identification unit, from which a colour formulation code can be read out, which serves as an operating parameter for the control unit, particularly that the identification unit comprises a RFID chip, in which the colour formulation code is saved. Alternatively and/or additionally the identification unit can be intended for the substrate, which is particularly assembled at a carrier of the substrate or which is assembled in or at the substrate, wherein a substrate code can be read out from the identification unit. Beneath the colour formulation likewise the substrate as such can be a great influence factor for the adjustment of the drying capacity. The colour formulation code and the substrate code can be automatically read out during the operation of the printing machine and can be transferred to the drying device according to the invention, which subsequently carries out an automatic adjustment of the drying capacity.

Advantageously, the measuring unit can be assembled in the suction unit whereby the to be sucked air from the substrate can be analysed. The measuring unit can measure the air according to the solvent, wherein subsequently it can be indicative for the colour formulation, which is an operating parameter for the control unit. For example it is possible that a gas chromatograph determines the solvent contained in the air.

According to the invention it is intended that the printing machine comprises multiple inking units, wherein a drying device is assigned to each inking unit. Each drying device can be configured from different modules, which each for itself can in turn comprise an air supply unit and a suction unit. Therewith the printing machine can be configured with a drying system with a plurality of drying devices, which each configure the drying process of the substrate applied to the colouring agent between two inking units.

It can be further advantageous to integrate a heat exchanger within the system, which provides resulting waste heat of the printing machine to the drying device. This waste heat can be provided for the air supply unit, from which a defined volume flow with a corresponding temperature is produced, which flows in the direction of the substrate for the drying process.

A further advantage of the invention results when a heat exchanger is intended, which provides resulting waste heat to the printing machine of the drying device, particularly the air supply unit. By a corresponding increase of the temperature an increase of the heat supply into the air occurs, which is blown in the direction of the substrate through the air supply unit, wherein the drying is accelerated. By the use of a heat exchanger the energy input of the system according to the invention can be further optimized.

The previously mentioned object is further solved by a method for the operation of a drying device according to all features of the independent claim 12. Hereby, a method is intended for the drying between inking units of the printing machine, by which a substrate is transported via rotating cylinders and is printed with colouring agents. According to the invention the drying device comprises an air supply unit for supplying air towards the substrate in order to effect a drying of the colouring agent. Further, the drying device comprises a suction unit for suctioning of the air and a measuring unit, with which at least a part of the operating parameters is determined during the operation of the printing machine. Further, according to the invention, a control unit is intended, which controls and/or regulates the air supply unit in dependence of the operating parameters in a way that altering drying areas are adjustable at the substrate. It is particularly advantageous that each drying device, which is assembled between two inking units, creates a drying area at the substrate in order to selectively achieve a drying of the printing image or the colouring agent on the substrate, wherein solvents evaporate during the drying process and are removed by the suction unit. Hereby, the energy input for operating the drying device can be selectively kept minimal since in dependence of the operating parameters the control unit can control the drying capacity. This means further that each drying device can be operated with different drying capacities since each inking unit uses different colouring agents and different printing images, different sizes of the printing images, different layer thicknesses during the colouring agent application and/or creates different printing degrees, which are considered via operating parameters in order to be able to adjust optimal drying areas at the substrate between each inking unit. Likewise here the advantages apply, which are already described for the system according to the invention or for the drying device according to the invention.

Advantageously the drying device can be controlled in dependence of the colouring agent supplied on the substrate, particularly the air supply unit and/or the suction unit can be controlled. Advantageously, the measuring unit can determine for example the thickness of the colour application of colouring agent and/or the printed area of the colouring agent and/or the printing degree, which influence the operating parameters in order to adjust the drying area at the substrate and finally determine the drying capacity of the drying device between each inking unit.

Likewise it is possible that at least a part of the operating parameters is transferred via an interface of the drying device and/or the printing machine. For example it is possible that the colour formulation code and/or the substrate code or data about the printing motive as operating parameters are read in via so called interface of the drying devices and/or the printing machine. The printing motive, which is for example assembled at the format cylinder particularly at the cliché of the format cylinder, can be evaluated in form of an image data, which have influence on the operating parameter in order to adjust individual drying areas at the substrate. The mentioned image data can already be available in digital form and can be transferred via the interface of the drying device and/or the printing machine.

Alternatively it is possible that the measuring unit determines the printing motive at the format cylinder and/or at the cliché of the format cylinder and out of this generates digital data, which is used as operating parameters for the control of the drying device.

Advantageously the operating parameters can be at least one of the following parameters:

- place and size of the colouring agent application at the substrate and/or at the cylinder;
- drying speed of the colouring agent;
- layer thickness of the colour application at the substrate;
- printing degree;
- colour formulation of the colouring agent and/or material of the substrate;
- gloss degree of the colour agent application at the cylinder and/or at the substrate;
- solvent amount in the air of the suction unit;
- transport speed of the substrate;
- temperature of the air in the suction unit and/or the air supply unit.

Said operating parameters can be determined or measured for example directly via the measuring unit according to the invention during the operation of the printing machine. Likewise the possibility occurs that via the measurement of defined parameters a part of said operating parameters can be calculated or determined via data bases, which are saved in the system according to the invention with the help of measuring units. The control unit can control and/or regulate the air supply unit and the suction unit via the operating parameters, this means that among others the volume flow of the air, which is responsible for the drying process, is adjusted accordingly wherein at the same time the air tempering regulation can be included in order to achieve a satisfying drying of the colouring agent. In case the drying capacity however is not sufficient in order to dry a given printing image with the adjusted transport speed of the substrate, the control unit can be configured in a way that the transport speed is reduced to a defined speed by which the printing image is just dried before it reaches the next inking unit particularly.

Further, the method according to the invention can be configured in a way that the drying device is operated in a circulating air procedure or in a circulation air procedure with a connectable fresh air procedure. Advantageously it has been shown that satisfying drying results can be achieved by air temperatures between 60° and 90°, wherein these do not lead to damages at the substrate material. Hereby, it has to be respected that different substrate materials are used, like for example paper, film from plastic, etc. in dependence of the substrate material, which as an operating parameter influences the calculation of the drying capacity, beneath the adjustment of the volume flow a corresponding temperature regulation can occur for the respective drying area.

Further, it can be an advantage that at the substrate and/or at the format cylinder and/or at an anilox roller of the inking unit of the printing machine the position and size of the colour agent application and/or the gloss degree and/or the drying speed can be determined, wherein particularly the position and the size of the colour application and/or the drying device is determined via the reflection of light at the surface of the format cylinder and/or the anilox roller. The degree of gloss can for example be measured by an optical sensor. For example the optical sensor can determine the degree of gloss by a reflection of light at the colouring agent surface of the anilox roller and/or at the format cylinder. This means that the areas of the anilox roller, by which no colour is applied to the format cylinder, comprise a different degree of gloss as the areas, by which a colour transfer to the format cylinder occurs. Therewith, the position and the size of the colour agent application to the substrate or the printing image can be implied. Likewise it is possible that an estimation of the drying speed can occur by measuring of the reflection of light at the colouring agent surface of the anilox roller and/or at the format cylinder wherein for example identification numbers or identification lines are already stored in a kind of data base within the system according to the invention. Via measuring points, which are a function of the reflection of light at the colouring agent surface and the time, the therefore assigned drying speed can be concluded. The drying speed in turn represents an operating parameter, which determines the drying capacity of the drying device, which means that within the drying speed of the drying device the volume flow, the temperature of the air is accordingly adjusted, which leaves the air supply unit in the direction of the substrate and is in turn discharged by the suction unit.

According to the invention the drying device can be used in a simple circulating air procedure. Likewise it is possible that the drying device is used in a circulating air procedure with a shiftable fresh air procedure. Hereby, it has to be considered that in a pure circulating air procedure the air can be continuously enriched with solvent during the drying, wherein with an increased percentage of solvent in the air the removal of the solvent from the colouring agent decreases wherein the actual drying speed of the substrate is reduced. Therewith, it can be meaningful to add a defined proportion of fresh air in order to decrease the concentration of the solvent in the circulating air. It can be a disadvantage that according to the temperature of the fresh air the circulating air is in turn heated up in order to achieve the desired drying capacity at the substrate. Advantageously, the drying device comprises a temperature sensor and a measuring unit, which can determine the percentage of solvent in the air.

Likewise it is possible that for the calculation of the necessary drying capacity of the single drying devices different methods are used, which can be summarized to a set value concerning the to be achieved drying capacities from different methods. Hereby, measurement errors can be reduced in the single methods. If for example the printed area and/or the printing degree can be measured with the sensor and also from an image data the method according to the invention, particularly the intelligent control unit for controlling and regulation of the single drying devices, can use the weighted means of the measured and determined values according to the printed area and/or the printing degree. For example the value of the printed area can be summarized to a determined value of approximately 60% from a measured value and approximately 40% from the image data.

According to the invention the area of the substrate, which is dried by the drying device can be limited to the area of the drying, which is printed in the previous inking unit or the previous inking units. If for example in the previous inking unit or previously inking units only the right and the left edge of the substrate is printed, the air supply unit of the subsequent drying device can only be active at the right and left edge. According to the complexity of the printing image it can also be an advantage that during the passing of the printing image at the drying device to open or close the nozzles or flaps in order to selectively direct an air flow to the areas of the substrate, which are equipped with the printing image. A measuring unit can be therefore intended, which previously determines and informs the control unit about the size and the position of the printing image at the substrate.

According to the invention image data of the cliché of the format cylinder can serve as operating parameters, particularly in order to determine the position and the size particularly the printing image at the substrate, which occurred by a colouring agent application.

BRIEF DESCRIPTION OF THE SEVERAL VIEWS OF THE DRAWINGS

Further advantages, features and details of the invention result from the subsequent description, in which possible embodiments of the invention are described in detail in relation to the drawings. Thereby the features mentioned in the claims and the description can be essential for the invention each single for themselves or in any combination. It is shown:

FIG. 1.1 a schematic drawing of the system according to the invention with the printing machine, which is configured with the printing unit between the inking units, FIG. 1.2 a further alternative of the system shown in FIG. 1.1, FIG. 1.3 a further embodiment of the system according to the invention according to FIG. 1.1, FIG. 2 a schematic drawing of the drying device, which is assembled behind a printing unit of a printing machine, FIG. 3 a schematic drawing of a drying device, which is configured with an air supply unit and a suction unit, FIG. 4 a further drawing of a drying device according to the invention with an air supply unit and a suction unit, FIG. 5 a further embodiment of the system according to the invention with a drying device and a measuring unit, which is assigned to the anilox roller, FIG. 6 a diagram from which the estimation of the drying speed can be evaluated, FIG. 7 a further schematic drawing of a system according to the invention with a drying device, which is in data communication with a control unit and a measuring unit, FIG. 8 a further view of a drying device shown in FIG. 7 and FIG. 9 a schematic drawing of a method according to the invention for the determination of an optimal drying capacity, which is assigned to each inking unit.

DESCRIPTION OF SPECIFIC EMBODIMENTS OF THE INVENTION

Figure 3:
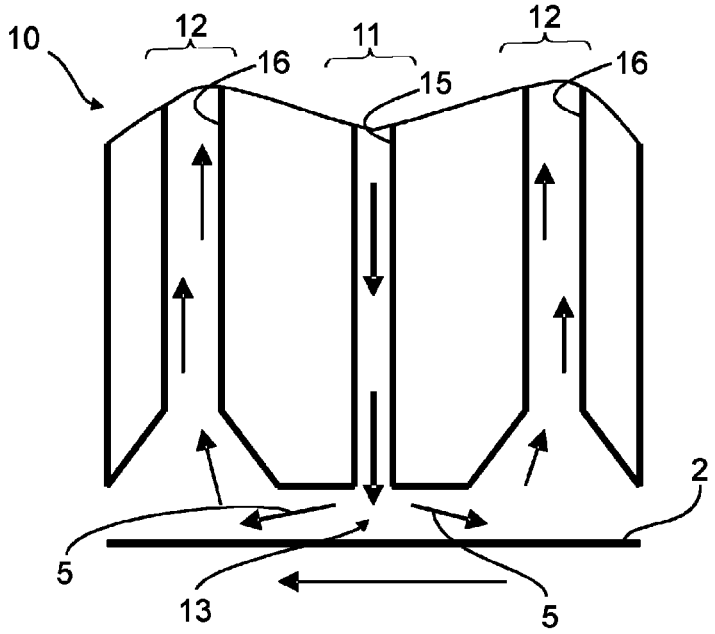

In FIGS. 1.1 to 1.3 a printing machine 1 according to the invention is shown respectively, which is configured from a plurality of inking units 7. In the shown figures five inking units 7.1 to 7.5 are shown exemplarily, wherein the amount of inking units 7 can vary, which does not affect the substantial matter of the invention.

Between the inking units 7 a drying device 10 according to the invention is assembled respectively. The printing machine 1 transports a substrate 2, which can for example be a paper material, a paper sheet or a plastic film, etc., via rotating cylinders 3.1, 3.2, 3.3, wherein the inking units 7 apply a printing image on the surface of the substrate 2. Hereby, a colouring agent 4 is applied to the surface of the substrate 2 via rotating cylinders 3.1, 3.2, 3.3. In the shown embodiments each inking unit 7 is composed of an anilox roller 3.1 and a format cylinder 3.2, wherein the anilox roller 3.1 comprises the colouring agent 4 from the paint container 31. The printing machine 1 can however comprise further constructive embodiments concerning the type of rotating cylinder, the amount of cylinder, etc. The substantial matter of all embodiments according to the invention is however, that a drying device 10 according to the invention is assembled between the inking units 7, which is in dependence of the operating parameters controlled in a way that the altering drying areas 13 like they are shown for example in FIG. 8 are adjusted at the substrate 2, which is subsequently described in detail.

Like it is explicitly shown in FIG. 2, FIG. 3, FIG. 7 and FIG. 8 the drying device 10 comprises an air supply unit 11 and a suction unit 12, which are integrated in an assembly unit in the present embodiment. The air supply unit 11 effects a supply of air 5 in the direction of the substrate 2 in order to achieve a selective drying of the inking unit 4 on the substrate 2. The air supply unit 11 comprises a supply channel 15, which proceeds in the centre towards the suction unit 12, which is responsible to discharge air 5. The air supply unit 11 comprises a supply channel 15 and the suction unit 12 in turn is configured with two spaced apart suction channels 16, wherein the supply channel 15 proceeds between the suction channels 16. During drying an evaporation arises of the solvents contained in the printing image. The air 5 is enriched with solvents, which are removed by the suction unit 12. A special feature of the invention is that the drying device 10 comprises a control unit 20, which in dependence of operating parameter B controls and/or regulates the air supply unit 11 and/or the suction unit 12 in a way that concerning the applied printing image corresponding drying areas 13 are established according to each inking unit 7 in order to achieve an optimized and selective drying at the substrate 2 between the respective inking units 7. Hereby, the energy requirement is significantly reduced during the operation of the printing machine 1 particularly because blank areas at the substrate 2 receive no or little drying by the drying device 10.

In order to however effect an optimal drying between the inking units 7 a plurality of operating parameters B has to be taken into account, which are necessary for the determination of the optimal drying capacity L, which is subsequently described.

Figure 4:
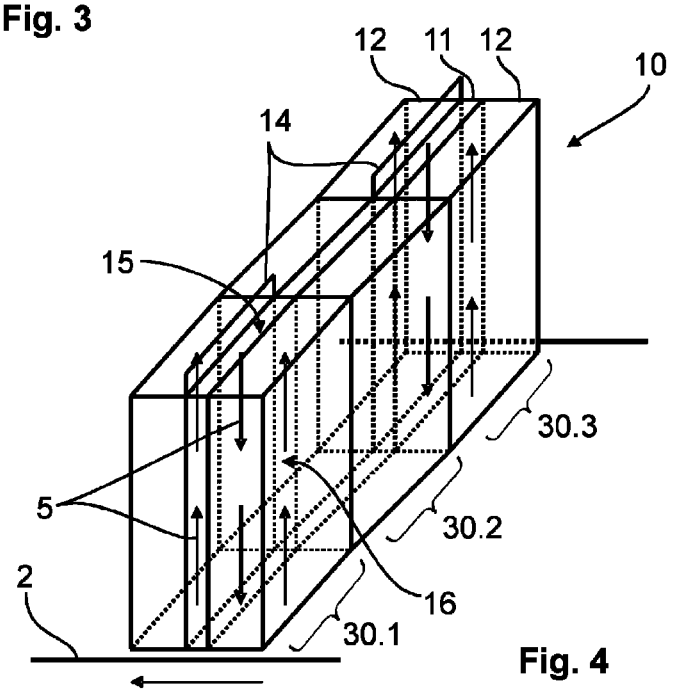
Figure 8:
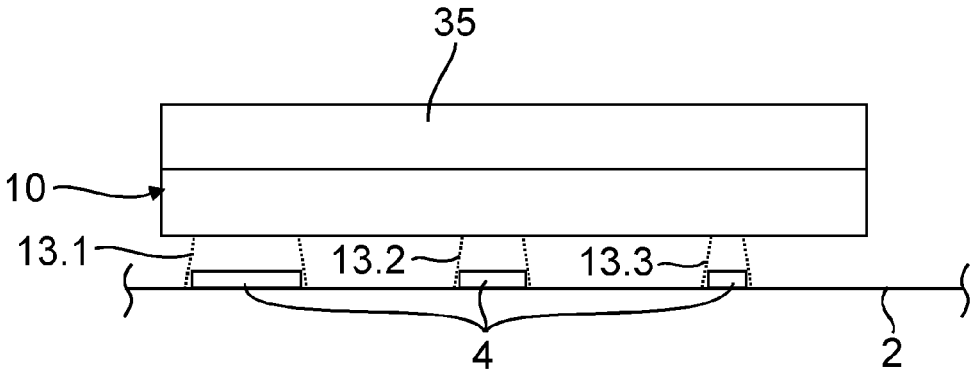

According to FIG. 2, FIG. 4 and FIG. 8 the air supply unit 11 and the suction unit 12 is oriented transversely to the transport direction of the substrate 2. In the present embodiment the drying device 10, which is assembled from an air supply 11 and a suction unit 12, is configured rod-like. The width of the transport device 10 can be greater than the width of the substrate 2, which is shown in detail in FIG. 2.

According to FIG. 4 it can be recognized that the air supply unit 11 comprises movable flaps 14, wherein different drying areas 13 are adjustable via the respective position of the flaps 14. Like it is schematically shown in FIG. 4 the drying device 10 comprises multiple modules 30.1, 30.2, 30.3, which each comprise an air supply unit 11 and a suction unit 12. The modules 30.1, 30.2, 30.3 can be individually controllable so that the volume flow and/or the temperature and/or the flow direction of the discharging air 5 is adjustable in the direction of the substrate 2 of each module 30.1, 30.2, 30.3.

The flaps 14 can be assembled on the side of the drying device 10 facing the substrate 2 alternatively and/or additionally the flaps 14 can be assembled on the side of the drying device 10 facing away from the substrate 2. If the flaps 14 of a module 30 are in their closed position no discharging air occurs from the module 30. Via this flap control an efficient inking unit drying can be performed selectively over the width of the substrate 2 (see FIG. 8). Using operating parameters B the control unit 20 of the drying device 10 determines the drying capacity L of the drying device 10, which is shown schematically in FIG. 9. In order to perform an efficient drying between the inking units 7 it is initially required to provide the necessary operating parameters B, which are visualized in the reference sign 60. The following operating parameters B influence the drying or the adjustment of the drying capacity of the drying device 10:

- position and size of the colouring agent application at the substrate 2 and/or at the cylinder;
- drying speed of the colouring agent 4;
- layer thickness of the colour application at the substrate 2;
- printing degree,
- colour formulation of the colouring agent 4 and/or material of the substrate 2;
- degree of gloss of the colouring agent application at the cylinder 3.1 and/or at the substrate 2;
- solvent amount of the air 5 in the suction unit 12;
- transport speed of the substrate 2;
- temperature of the air 5 in the suction unit 12 and/or in the air supply unit 11.

Figure 9:
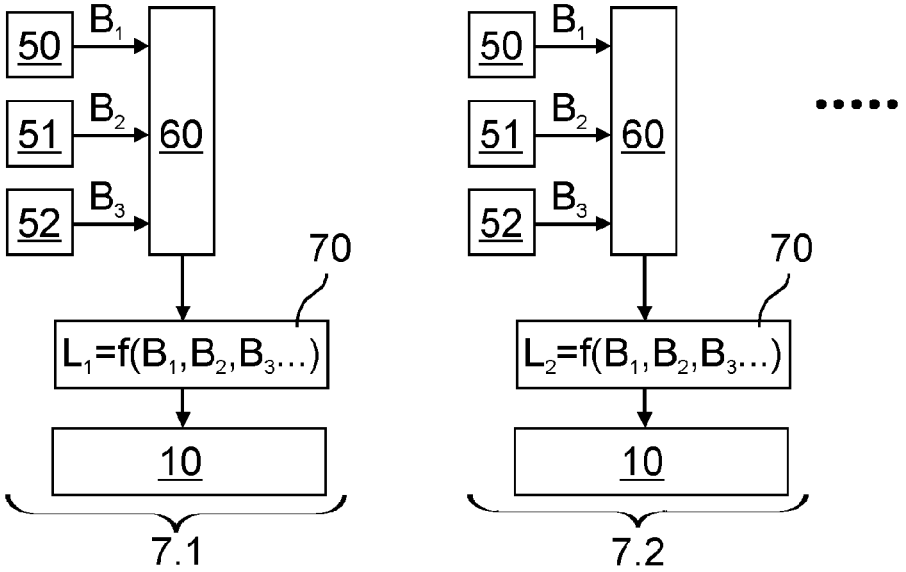

For example it is possible that a part of said operating parameters B are determined via a measurement according to the reference sign 50 (FIG. 9). Therefore a measuring unit 40 can be intended, which is for example configured with an optical sensor 41. The measuring unit 40 is according to FIG. 1.1 directed to the substrate 2 between the two inking units 7 respectively. The measuring unit 40 can determine the position and the size of the colour agent application at the substrate 2, which is shown schematically in FIG. 7. Subsequently this information is transferred to the control unit 20, which thereupon adjusts the drying device 10 according to the drying capacity L. At the same time it is possible that in dependence from other parameters the temperature of the air 5 flowing in the direction of the substrate 2 is adjusted and/or regulated within the drying device 10. According to FIG. 8 it is schematically shown that the system according to the invention is configured with a heat exchanger 35, which provides the resulting heat waste of the drying device 10 or the air supply unit 11 in the printing machine 1.

Alternatively the measuring unit 40 can optically review the surface of the format cylinder 3.2 and/or the surface of the anilox roller 3.1, which is shown in FIG. 1.2 or 1.3. Via the recognized image data conclusions to the position and size of the printing image can be drawn between the inking units 7 so that the control unit 20 performs a corresponding control and regulation of the drying device 10.

Figure 6:
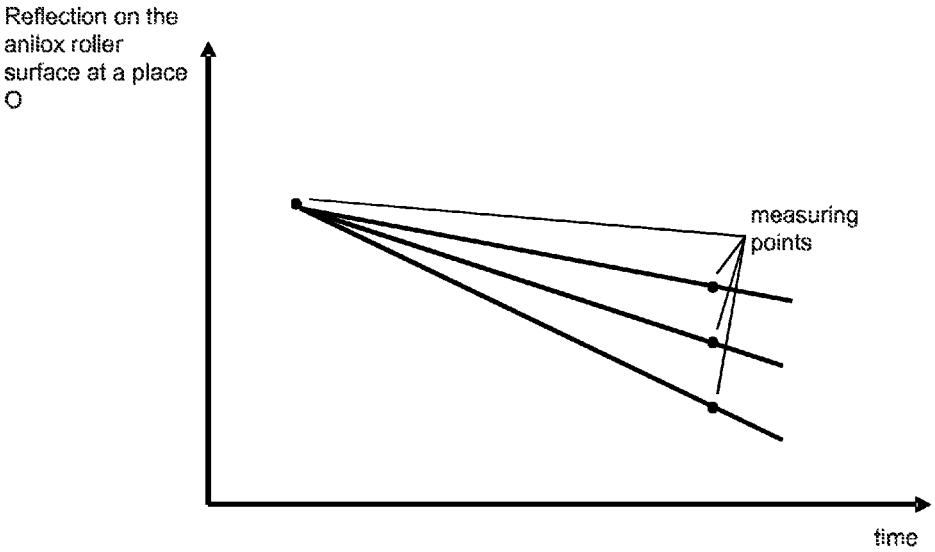
Figure 7:
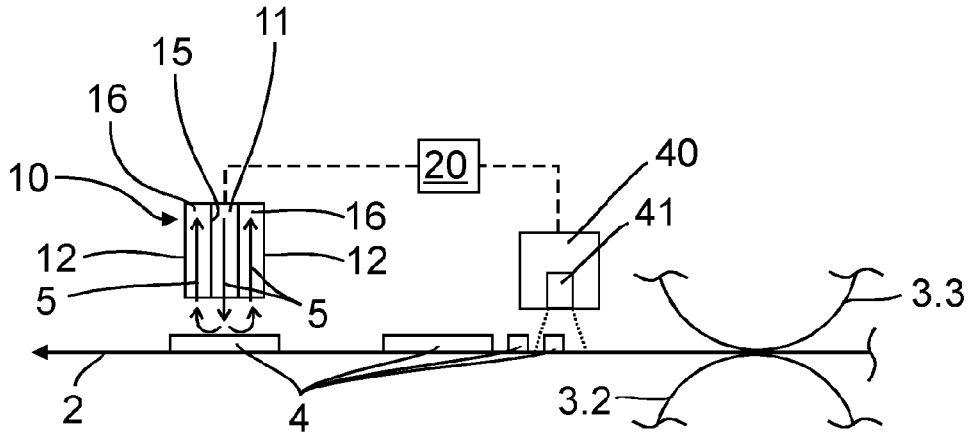

In a further embodiment according to FIG. 6 it is possible to determine the drying speed of the colouring agent 4 using a measurement of reflection of light at the colour surface of the anilox roller 3.1 and/or the format cylinder 3.2. The measuring unit 40 according to FIG. 1.2 or FIG. 1.3 determines the reflection of light wherein different drying speeds can be estimated by the control unit 20 using already existing measurement curves. In FIG. 6 three measuring points lying mainly on top of each other are shown exemplarily. The upper measuring point is on a drying function, which is associated with a slow drying speed. The middle drying function constitutes a normal drying speed. The lower drying function constitutes a high drying speed. Since the operating parameter of the drying speed is likewise a significant size for the influence of the adjusting drying capacity of the drying device 10 it can be meaningful to involve operating parameters according to the invention with a selective energy supply for the drying process.

Via the measuring unit 40 further the printing degree, the gloss degree and/or the layer thickness of the colour application of the colouring agent 4 at the substrate 2 can be determined, which can be essential operating parameters B for the determination of the drying capacity L like just described. Likewise a solvent amount of the air 5 can be determined in the suction unit 12 via the measuring unit 40, wherein for example the drying speed and/or the necessary drying capacity L of the drying device 10 can be determined.

Concerning FIG. 9 it is likewise possible that the operating parameters B at least partially are already available at the system according to the invention (see reference sign 51). For example it is possible that each paint container 31 of each inking unit 7 comprises an identification unit 32, which can be read out from a colour formulation code, which serves as an operating parameter B for the control unit 20. Hereby, the identification unit 32 can comprise a RFID chip, in which the colour formulation code is saved. Via the colour formulation code a corresponding consideration concerning the drying capacity L can occur. Likewise for the substrate 2 an identification unit can be intended in the system according to the invention, like for example at a carrier of the substrate 2 particularly at its wrap. The identification unit can further be assembled directly in or at the substrate 2, wherein a substrate code can be read out from the identification unit, which a control unit 20 comprises for the consideration of the drying capacity L.

According to FIG. 1.2 it is possible that the measuring unit 40, which is assigned to the format cylinder 3.2 is movable and/or rotatable so that at another position the measuring unit 40 can also be directed to the substrate 2 and therewith to the printing image or can adapt a position, which can be optically analysed and/or monitored in the anilox roller 3.2.

The colour formulation code can be read out via the identification unit 32 and can be transferred to the control unit 20.

The acquisition of the necessary operating parameters (reference sign 60) can therewith occur according to the described methods 50, 51, 52 from FIG. 9. The input of operating parameters (reference sign 52) can for example occur by a not explicitly shown interface by the operator of the printing machine 1. Subsequently an optimal adjustment of the respective drying device 10 occurs by the control unit 20 in order to selectively and in an energy optimized manner dry the substrate 2 via the altering drying areas 13.

Figure 5:
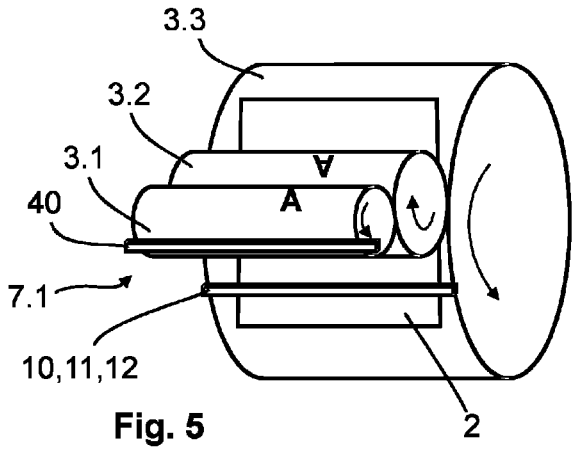

In FIG. 5 mainly the embodiment according to FIG. 1.3 is shown, by which the drying device 10 is directed to a substrate 2 and at the same time the measuring unit 40 analyses the surface of the anilox roller 3.1, like already described. The optical verification of the surface of the anilox roller 3.1 can occur via a reflection sensor, gloss sensor or via a camera unit, particularly a line scan camera.

Like it is schematically shown in FIG. 9 for each drying device 10 an individual determination of the drying capacity L occurs so that between the inking units 7 different drying areas 13 occur. This means that within the drying device 10 in dependence from the moving substrate 2 the drying areas 13 can vary according to FIG. 8, this means that the amount of the drying areas can increase or can decrease or the size of the drying areas can vary likewise. This is dependent from the previously mentioned operating parameters particularly from the position and size of the colouring agent application, the layer thickness of the colour application, the printing degree, the colour formulation of the colouring agent 4, the material of the substrate 2, the solvent amount of the colouring agent 4, the transport speed of the substrate 2 etc.

According to the determined size of the drying capacity L, which has to be adjusted for each drying device 10, it can be necessary to additionally adjust the temperature of the air 5 in the air supply unit 11 and/or also to accordingly adjust the transport speed of the substrate 2.

In a not explicitly shown embodiment it can be likewise intended that the control unit 20 is assembled central in and/or at the printing machine or in a drying device 10, which determines the necessary drying capacity L for all drying devices 10. Likewise it is possible that the measuring unit 40 and the drying device 10 are integrated in a common component.

REFERENCE SIGN

1 Printing machine
2 Substrate
3.1 Cylinder, anilox roller
3.2 Format cylinder
3.3 Pressure cylinder
4 Colouring agent
5 Air
7 Inking unit
7.1 Inking unit
7.2 Inking unit
7.3 Inking unit
7.4 Inking unit
7.5 Inking unit
10 Drying device
11 Air supply unit
12 Suction unit
13.1 Drying area
13.2 Drying area
13.3 Drying area
14 Flap
15 Supply channel
17 Suction channel
20 Control unit
30.1 Module
30.2 Module
30.3 Module
31 Paint container
32 Identification unit
35 Heat exchanger
40 Measuring unit
41 Optical sensor, camera
50 Measurement of operating parameters
51 Presence of operating parameters
52 Input of operating parameters
60 Acquisition of operating parameters
70 Determination of the drying capacity L
B Operating parameter
L Drying capacity

What is claimed is:

1. Drying device for a drying between inking units of a printing machine which is adjustable between the inking units, with which a substrate is transported via rotating cylinders and is printable with a colouring agent, with an air supply unit for supplying of air in direction of the substrate to effect a drying of a surface with the colouring agent, a suction unit for discharging the air, a control unit, which at least controls or regulates the air supply unit according to an estimation of drying time of the colouring agent based on a degree of gloss and a calculation of a weighted combination of at least one operating parameter, for altering drying areas of the substrate, wherein each of said at least one operating parameter is a member of a group consisting of:

a position and a size of a colouring agent application at the substrate or at the cylinder, a layer thickness of the colour application at the substrate, a printing degree, a colour formulation of said colouring agent, a type of material of the substrate measured solvent amount in the air in the suction unit, and a transport speed of the substrate; and an optical sensor adapted to determine said degree of gloss of the applied colouring agent by measuring a reflection of light at the surface with the colouring agent during the operation of the printing machine.

2. Drying device according to claim 1, wherein the air supply unit is adjusted transversely to the transport direction of the substrate and comprises movable flaps, wherein an alternating flow direction is achievable for the discharge of the air from the air supply unit.

3. Drying device according to claim 1, wherein multiple modules are intended, which each comprise an air supply unit and a suction unit, wherein the modules are individually controllable by the control unit and wherein at least the volume flow or the temperature or the flow direction of the discharging air in the direction of the substrate of each module is individually adjustable.

4. System with a drying device for drying between inking units of a printing machine, by which a substrate is transportable via rotating cylinders and printable with colouring agents with an air supply unit for the supply of air in the direction of the substrate to effect a drying of the colouring agent, a suction unit for discharging of air, a measuring unit adapted to:

use an optical sensor for a degree of gloss at the surface with the applied colouring agent by measuring a reflection of light during the operation of the printing machine; and a control unit, which at least controls or regulates the air supply unit according to an estimation of drying time of the colouring agent based on a degree of gloss and a calculation of a weighted combination of at least one operating parameter, for altering drying areas at the substrate, wherein each of said at least one operating parameter is a member of a group consisting of:

a position and a size of a colouring agent application at the substrate or at the cylinder, a layer thickness of the colour application at the substrate, a printing degree, a colour formulation of said colouring agent, a type of material of the substrate, measured solvent amount in the air in the suction unit, and a transport speed of the substrate;

wherein the printing machine comprises multiple inking units, wherein to each inking unit a drying device is assigned.

5. System according to claim 4, wherein said optical sensor is a camera unit directed to at least the substrate or to at least one cylinder.

6. System according to claim 4, wherein to the printing machine at least one paint container is assigned, in which the colouring agent is insertable, wherein a colour formulation code is read out of said paint container by an identification unit, said colour formulation code serves as an operating parameter for the control unit and wherein a substrate code is read out by another identification unit assembled at a carrier of the substrate, said substrate code serves as another operating parameter for the control unit.

7. System according to claim 4, wherein a heat exchanger is intended, which provides arising heat waste of the printing machine of the air supply unit.

8. Method for the operation of a drying device for drying between inking units of a printing machine, by which a substrate is transported via rotating cylinders and is printed with colouring agents with an air supply unit for the supply of air in the direction of the substrate to effect a drying of a surface with the colouring agent, a suction unit for discharging of the air, an optical sensor adapted to determine a degree of gloss of the applied colouring agent by measuring a reflection of light at the surface with the colouring agent during the operation of the printing machine, and a control unit, which at least controls or regulates the air supply unit according to an estimation of drying time of the colouring agent based on a degree of gloss and a calculation of a weighted combination of at least one operating parameter, for alternating drying areas at the substrate, wherein each of said at least one operating parameter is a member of a group consisting of:

a position and a size of a colouring agent application at the substrate or at the cylinder, a layer thickness of the colour application at the substrate, a printing degree, a colour formulation of said colouring agent, a type of material of the substrate, measured solvent amount in the air in the suction unit, and a transport speed of the substrate;

wherein the drying device is controlled in dependence from the colouring agent applied to the substrate.

9. Method according to claim 8, wherein said group is further consisting of a temperature of the air at least in the lion unit or in the air supply unit.

10. Method according to claim 8, wherein the drying device (10) is operated in a circulating air process or is operated in a circulated air process with a connectable fresh air process.

11. Method according to claim 8, wherein at least at the substrate or at a format cylinder or at an anilox roller of the inking unit of the printing machine the position and size of at least a colouring agent application or the drying time is determined via at least the reflexion of air at the surface of the format cylinder or at the anilox roller.

12. Method according to claim 8, wherein image data of a cliche of a format cylinder serve as operating parameters.

13. Method according to claim 8 for operating at least a system with a drying device for drying between inking units of a printing machine, by which the substrate is transportable via the rotating cylinders and printable with the colouring agents with the air supply unit for the supply of air in the direction of the substrate to effect a drying of the colouring agent.

14. The Drying device of claim 1, wherein said at least one operating parameter is a position and a size of a colouring agent application at the substrate or at the cylinder.

15. The Drying device of claim 1, wherein said at least one operating parameter is a layer thickness of the colour application at the substrate.

16. The Drying device of claim 1, wherein said at least one operating parameter is a printing degree.

17. The Drying device of claim 1, wherein said at least one operating parameter is a colour formulation of said colouring agent.

18. The Drying device of claim 1, wherein said at least one operating parameter is a type of material of the substrate.

19. The Drying device of claim 1, wherein said at least one operating parameter is measured solvent amount in the air in the suction unit.

20. The Drying device of claim 1, wherein said at least one operating parameter is a transport speed of the substrate.

* * * * *